US006585246B2

(12) United States Patent
McCormick et al.

(10) Patent No.: US 6,585,246 B2
(45) Date of Patent: Jul. 1, 2003

(54) ELECTRIC CLAMP

(75) Inventors: Peter Elliott McCormick, Dallas, TX (US); Daniel Alan Beall, Allen, TX (US); Detlev Ulle, Reichelsheim (DE)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 09/887,293

(22) Filed: Jun. 22, 2001

(65) Prior Publication Data

US 2002/0195762 A1 Dec. 26, 2002

(51) Int. Cl.[7] ..... B25B 1/04; B25B 5/04

(52) U.S. Cl. ..... 269/239; 269/32; 269/228; 269/24; 269/27

(58) Field of Search ..... 269/32, 228, 27, 269/25, 31, 201, 24, 233

(56) References Cited

U.S. PATENT DOCUMENTS 3,599,957 A * 8/1971 Blatt ..... 269/32
4,458,889 A * 7/1984 McPherson et al. ..... 269/32
4,770,401 A * 9/1988 Donaldson ..... 269/32
5,165,670 A * 11/1992 Sawdon ..... 269/32
5,912,541 A 6/1999 Bigler et al.
5,996,984 A * 12/1999 Takahashi ..... 269/32
6,220,588 B1 * 4/2001 Tunkers ..... 269/32

* cited by examiner

*Primary Examiner*—Lee D Wilson
(74) *Attorney, Agent, or Firm*—Brian F. Russell; Bracewell & Patterson, L.L.P.

(57) ABSTRACT

An electrically powered clamp has a housing, a motor attached to the housing, a ball screw driven by the motor via gears, and a linkage driven at one end by the ball screw such that the linkage rotates an output shaft attached to the other end of the linkage. The motor and gears drive the ball screw to a fully extended position to rotate the shaft to a clamped position or to a fully retracted position to rotate the shaft to an unclamped position. A built-in computer monitors and controls the clamp. The clamp can also be controlled and monitored by a remote pendant. Indicator lights on the housing and remote pendant convey clamp status information. The clamp is programmable and can memorize the clamped and unclamped positions. The clamp uses velocity and position feedback to determine appropriate drive mode. Torque monitors and timers determine if the clamp becomes stuck.

21 Claims, 4 Drawing Sheets

ELECTRIC CLAMP

BACKGROUND OF THE INVENTION

1. Field of the Invention

This invention pertains to power clamps and more particularly to clamps driven by electric motors. Clamps are used to secure an object to aid assembly or to secure it during transport from one location to another.

2. Description of Prior Art

The robotics and automation industry heavily relies on power clamps for securing objects such as mechanical or electrical components so those components can be integrated into an assembly or moved from one assembly station to another. Clamps of various sizes, shapes, and configurations have been used to secure objects ranging in size from as small as electronic circuit boards to as large as entire automobile body panels. Clamps can be comprised of opposing members, but are more commonly mounted to a work surface and use one arm to pin the object against the work surface.

The majority of clamps currently used in the automation industry are pneumatically powered. This is primarily due to the significantly greater power obtainable from a pneumatically powered clamp compared to existing electrical clamps of similar size. Disadvantages of prior versions of electric clamps include being large, complex, delicate, or expensive.

SUMMARY OF THE INVENTION

The present invention uses an innovative design to produce an electric clamp with high clamping power in a small and relatively inexpensive package. The clamp of the present invention comprises an electrically powered clamp having a housing, a motor attached to the housing, a ball screw driven by the motor via gears, and a linkage driven at one end by the ball screw such that the linkage rotates an output shaft attached to the other end of the linkage. The motor and gears drive the ball screw to a fully extended position to rotate the shaft to a clamped position or to a fully retracted position to rotate the shaft to an unclamped position. A built-in computer monitors and controls the clamp. The clamp can also be controlled and monitored by a remote pendant. Indicator lights on the housing and remote pendant convey clamp status information. The clamp is programmable and can memorize the clamped and unclamped positions. The clamp uses velocity and position feedback to determine appropriate drive mode. Torque monitors and timers determine if the clamp becomes stuck.

BRIEF DESCRIPTION OF THE DRAWINGS

So that the manner in which the described features, advantages and objects of the invention, as well as others which will become apparent, are attained and can be understood in detail, more particular description of the invention briefly summarized above may be had by reference to the embodiments thereof that are illustrated in the drawings, which drawings form a part of this specification. It is to be noted, however, that the appended drawings illustrate only typical preferred embodiments of the invention and are therefore not to be considered limiting of its scope as the invention may admit to other equally effective embodiments.

In the drawings.

DETAILED DESCRIPTION

Figure 1:
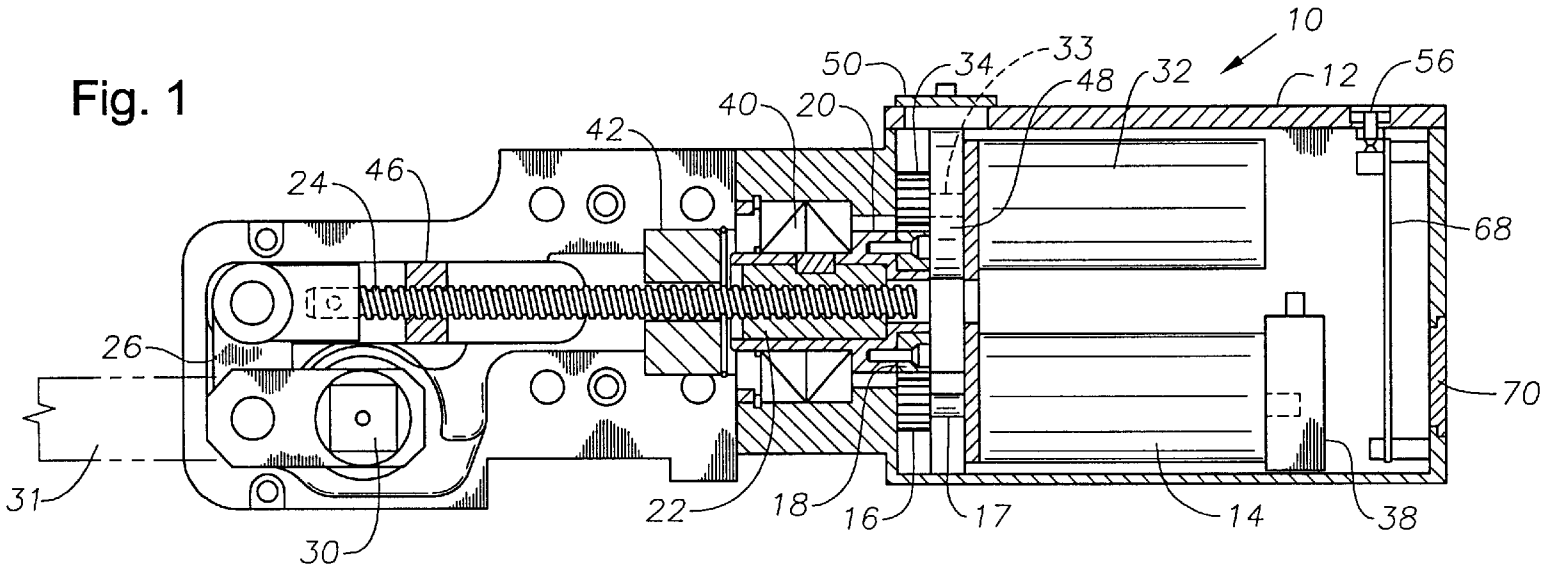
FIG. 1 is a side view of an electric clamp constructed in accordance with the present invention showing the clamp in its clamped position.
Figure 2:
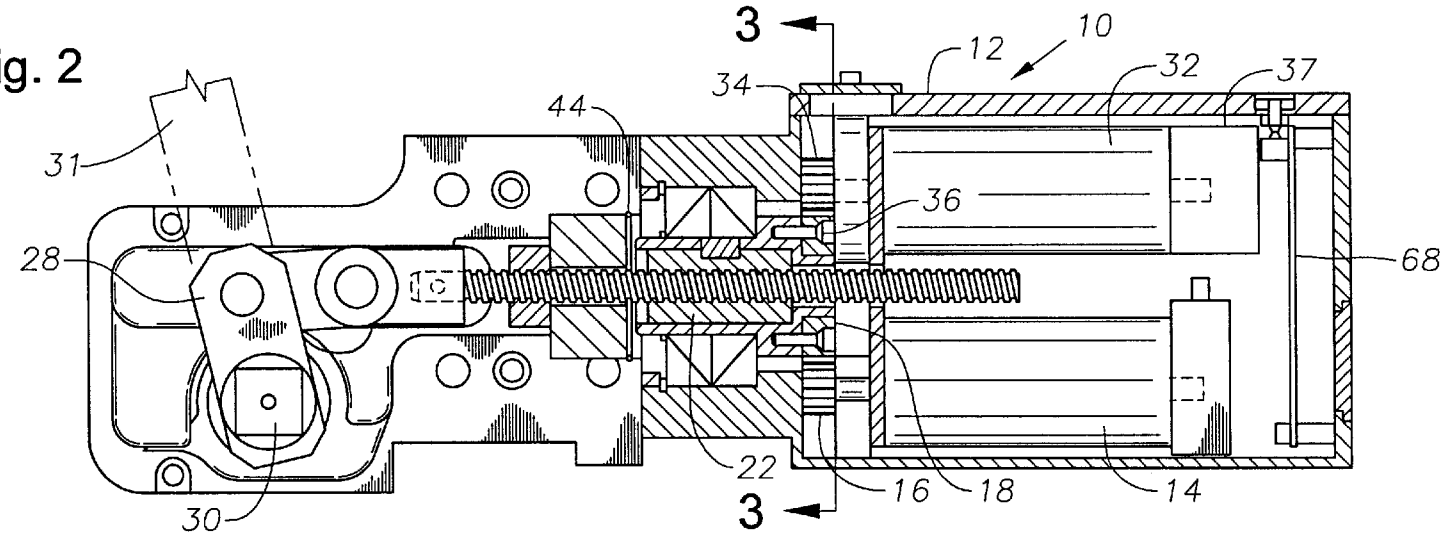
FIG. 2 is a side view of the clamp of FIG. 1, but showing the clamp in its unclamped position.

FIGS. 1 and 2 illustrate an electric clamp 10. Electric clamp 10 has a housing 12 that serves as a base on and inside of which other structural elements are mounted. Housing 12 protects the housed components. Housing 12 can be made of any durable, lightweight material, but is preferably metal or another conductive material that can be electrically grounded. It is desirable that housing 12 be easily formed into complex shapes to allow for space-efficient integration of various components.

Electric clamp 10 further comprises a motor 14. Motor 14 is a conventional electrically driven motor that mounts to housing 12 and serves to drive motor gear 16. The motor 14 can be virtually any type of electric motor. Different applications may dictate whether the motor is preferably an ac or dc motor, a stepper motor, an induction motor, a brushless motor, or other less common motor type. A dc motor offers the advantages of low cost and simple control requirements, but other requirements may dictate other motor types. Larger motors are generally required for larger clamps.

Figure 3:
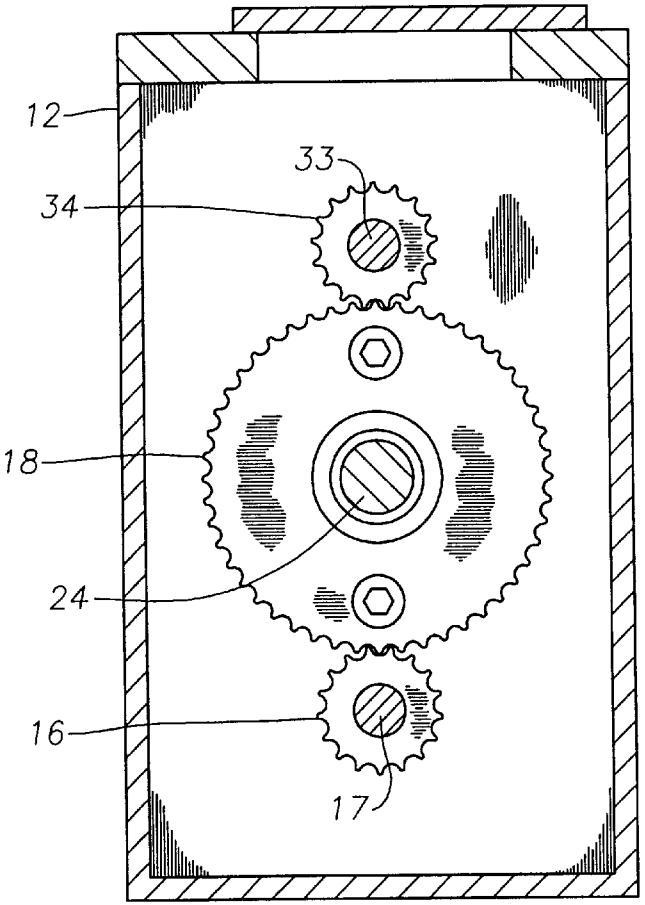
FIG. 3 is a section view along Section 3—3 of FIG. 2.

Motor gear 16 is on the output shaft 17 of motor 14 and engages ball nut gear 18 (FIG. 3). Ball nut gear 18 attaches to and drives ball nut hub 20 in response to motor gear 16. Hub 20 attaches to and drives ball nut 22. As ball nut 22 is rotated in place by hub 20, ball screw 24, a threaded shaft going through ball nut 22, advances or retreats depending on the direction of rotation of ball nut 22. The gear ratios for motor gear 16 and ball nut gear 18 can be chosen to produce a desired torque or rotational rate for ball nut 22. That determines the power or rate of advance/retreat of ball screw 24.

One end of ball screw 24 pivotally attaches to one end of link 26. The opposite end of link 26 pivotally attaches to an end of link 28. Clamp output shaft 30 is rigidly attached to the opposite end of link 28. Clamp arm 31 (shown in phantom line) is mounted to clamp output shaft 30. Clamp arms of various sizes can be attached, depending on a user's needs.

In the embodiment of FIG. 1, slave motor 32 is used to provide additional torque. Slave motor 32 is wired in parallel with motor 14 to assist motor 14. The same voltage is applied to both motors. Slave motor 32, through its output shaft 33, drives motor gear 34, which drives ball nut gear 18, each identical in operation to motor 14, output shaft 17, and motor gear 16, respectively.

In the basic operation of clamp 10 of FIG. 1, power is supplied to motors 14 and 32 to drive motor gears 16 and 34. Those gears drive ball nut gear 18, which drives hub 20. Hub 20 rotates ball nut 22. Ball nut 22 drives ball screw 24, which drives links 26 and 28, rotating clamp output shaft 30 to a fully clamped (FIG. 1) or fully released (FIG. 2) position, depending on the direction of rotation of ball nut 22.

FIG. 2 shows an optional brake 37 attached to the motor shaft 33 of slave motor 32 that can be used to stop slave motor 32, and therefore stop the motion of clamp 10. Brake 37 may be required if large clamp arms having high rotational inertia or significant weight are used. In those situations, the inertia or moment may cause clamp 10 to move toward the clamped or unclamped position even though no power is applied. Brake 37 prevents such drift.

While the structural elements described above are sufficient to describe the basic configuration and operation of clamp 10, there are many other elements that enhance its functionality. Encoder 38 mounts to motor 14. The encoder 38 shown in FIG. 1 attaches to motor shaft 17 of motor 14. Encoder 38 provides motor angle information for position feedback. The motor angle information tells how far motor 14 has rotated from the clamped or unclamped position, therefore determining the position of clamp arm 31. An absolute or incremental encoder can be used, or another type of motor position sensor, such as a resolver, can be used.

Ball nut 22 is supported by thrust bearing 40. Thrust bearing 40 mounts between housing 12 and ball nut 22 and carries the thrust load generated during the clamping process. Similarly, ball screw 24 is supported by support bearing 42. Bearing 42 mounts between housing 12 and ball screw 24 and prevents lateral loads from being transferred to ball screw 24 during extreme loading conditions. Bearing 42, in conjunction with retainer ring 44, also acts as a barrier to prevent grease from moving from links 26, 28 into the vicinity of ball nut 22.

Stop collar 46 is adjustably fixed to ball screw 24 and physically inhibits further retraction of ball screw 24 once stop collar 46 is pulled into contact with bearing 42. This feature is useful to prevent clamp 10 from opening too far. The need for restriction commonly arises when objects in the vicinity of clamp 10 interfere with the full range of motion of clamp 10, particularly when longer clamp arms are used.

Figure 4:
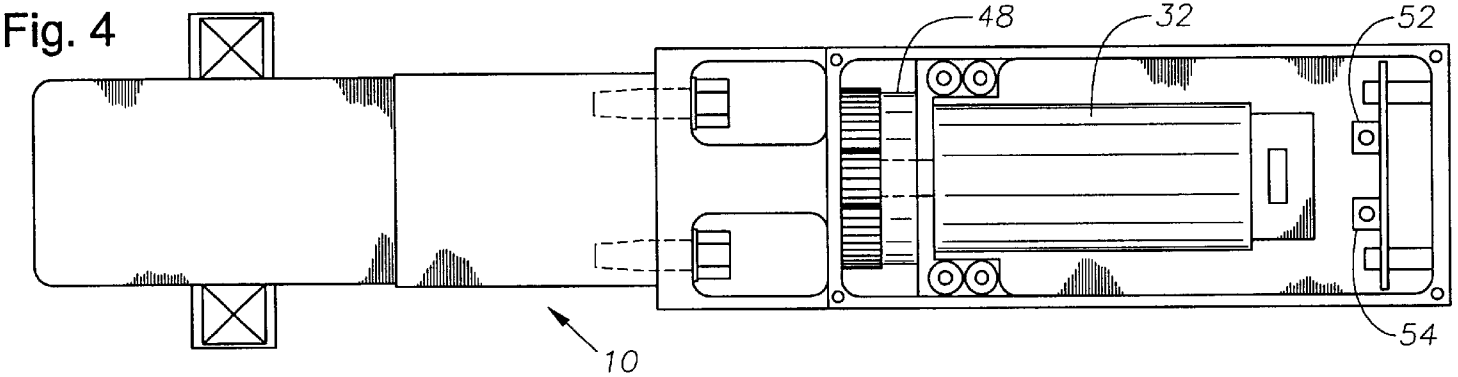
FIG. 4 is a top view of the clamp of FIG. 1 with cover removed.

FIG. 4 shows thumb wheel 48 attached to the motor shaft of slave motor 32. Wheel 48 allows clamp 10 to be moved without electrical power. This is useful when no power is available, such as during initial setup, or when the drive control electronics (described below) are unavailable. This can occur when clamp 10 becomes extremely stuck or the electronics themselves fail. Wheel 48 is normal concealed and protected by access cover 50, as shown in FIG. 5.

Figure 5:
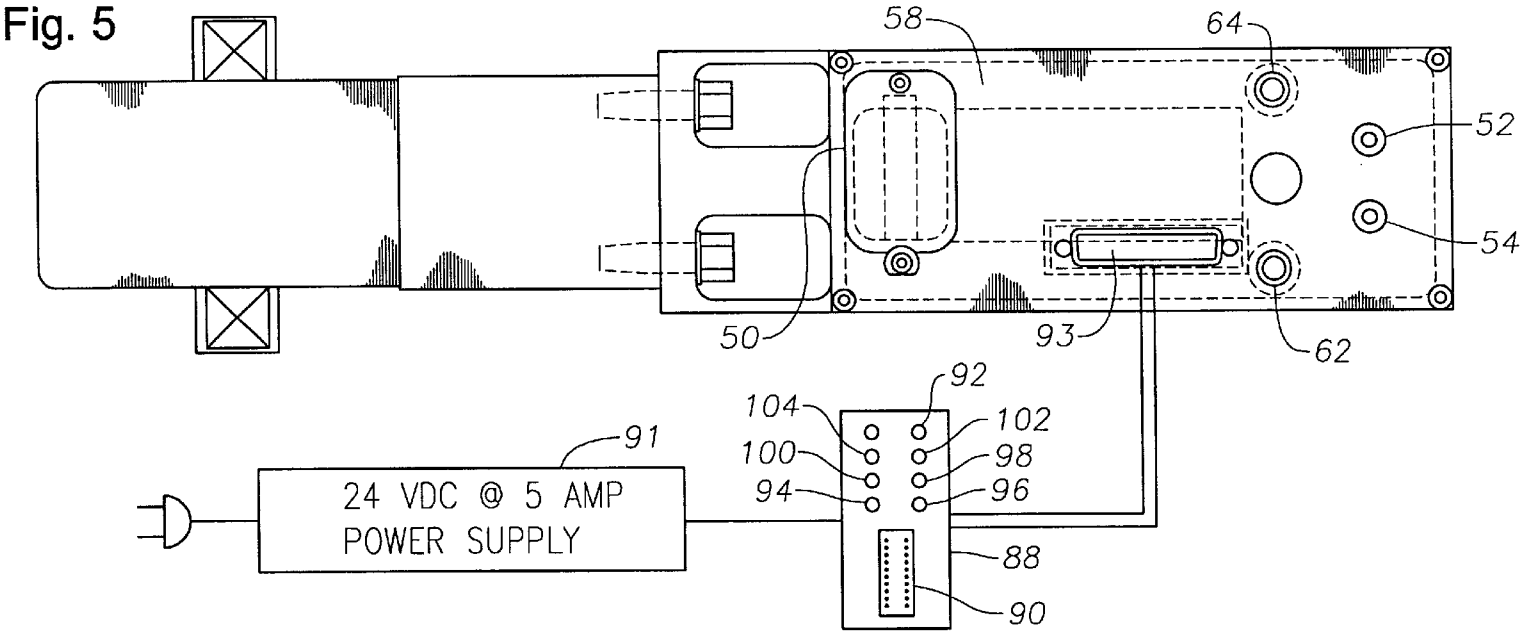
FIG. 5 is a top view of the clamp of FIG. 1 with cover on and remote pendant attached.

FIG. 5 also shows clamp buttons 52 and 54. Buttons 52, 54 allow a user to drive clamp 10 to a clamped or unclamped position, respectively. The motion produced is relatively slow in both directions and clamp 10 moves only while a button is depressed. Buttons 52, 54 are located in recesses 56 (FIG. 1) in cover plate 58. Recesses 56 are covered to prevent infiltration of contaminates and to prevent inadvertent engagement of buttons 52, 54. A pointed tool, such as a screwdriver, is needed to actuate buttons 52, 54.

Figure 6:
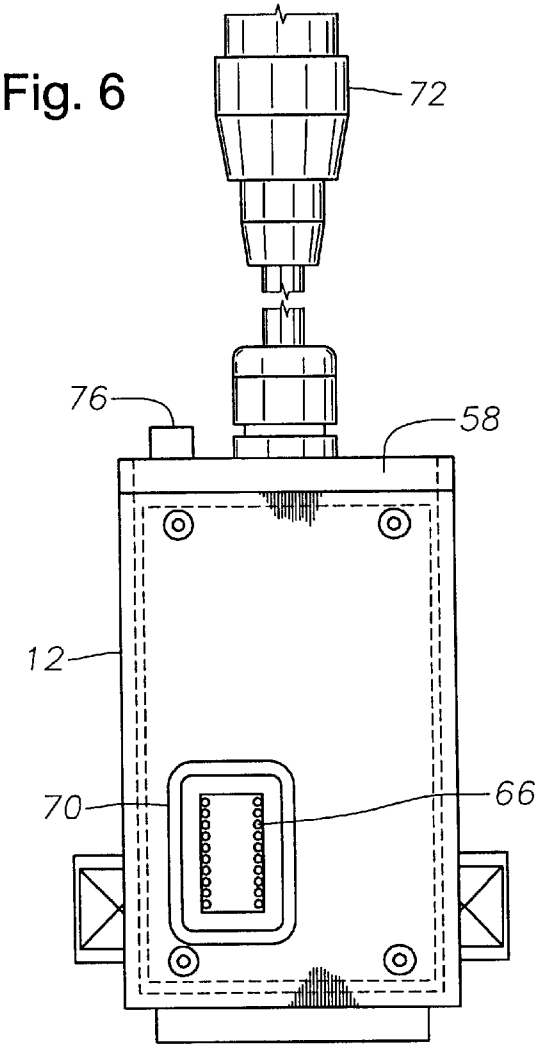
FIG. 6 is an end view of the clamp of FIG. 1.

Also located on cover plate 58 are status lights 62, 64. Clamped status light 62, when lit, indicates clamp 10 is very close to the programmed clamped position. (The programmable aspects are discussed below.) Similarly, unclamped status light 64 lights up when clamp 10 is very close to the programmed unclamped position. In addition, there are indicator lights 66 (FIG. 6) on control circuit board 68 (FIG. 2) within housing 12. Indicator lights 66 are viewed through window 70 (FIG. 1) and provide an operator information about the operational state of clamp 10.

Electrical power is primarily supplied to clamp 10 through control cable 72 (FIG. 6), which fastens to cover plate 58 and electrically connects a wire bundle to electronics within housing 12. Power could be dc, ac, 24 volts, or 48 volts—a preferred embodiment uses 24 volts dc. Higher voltages, such as 110 or 220 ac voltages, could be used, but are generally considered unacceptable because of safety concerns. Electrical power is typically provided by an external power supply with enough current capacity to service several clamps.

Other electrical signals, such as a command signal from the user or clamp status information, are also transmitted through control cable 72. The electronics within housing 12 include control circuit board 68 (FIG. 1). Control board 68 has the circuitry necessary to control clamp 10.

Figure 7:
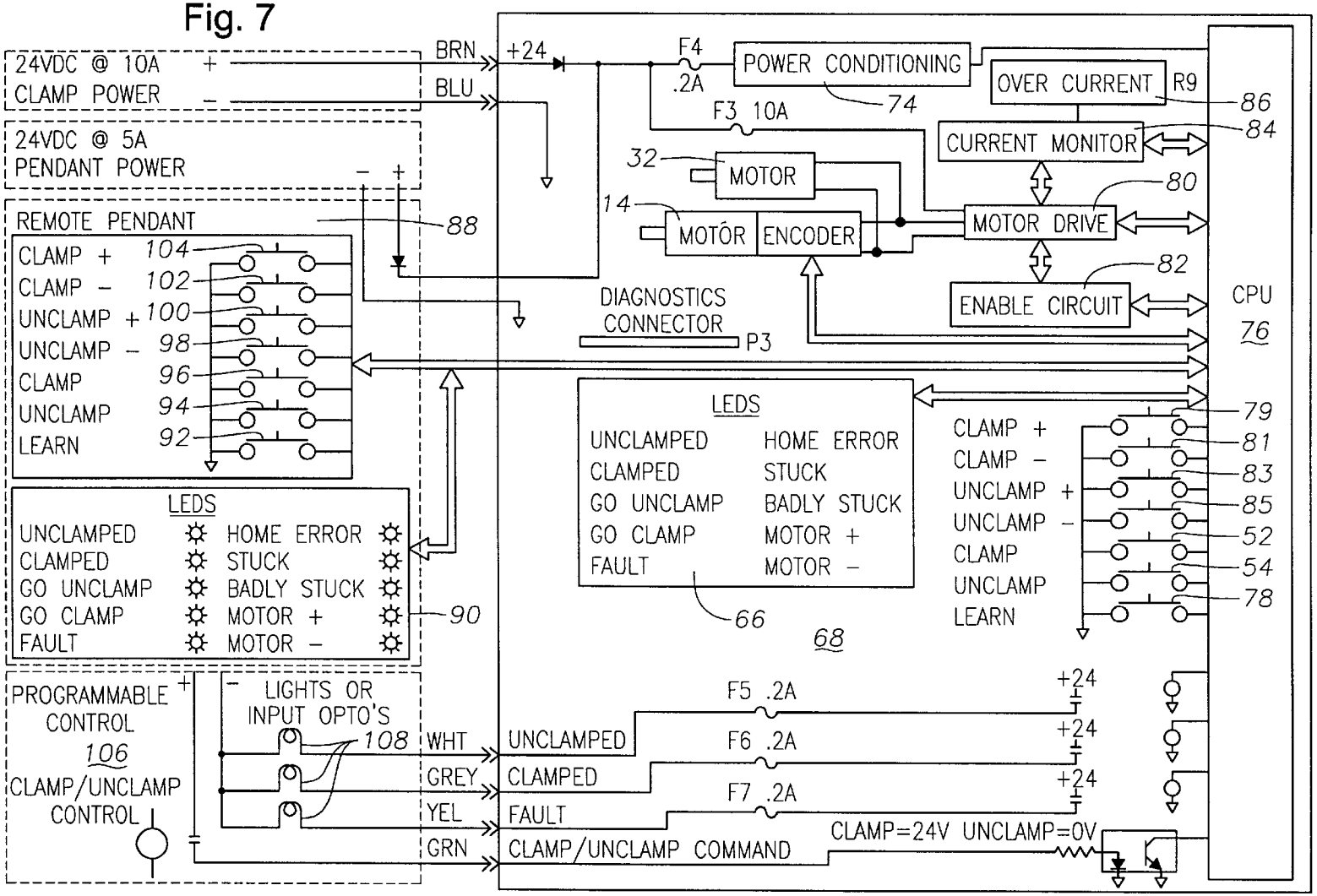
FIG. 7 is a schematic diagram of the electronics used in the clamp of FIG. 1.

FIG. 7 shows conceptually the electronic components comprising control board 68. Power conditioner 74 is used to provide clean 5 and 15 volts dc signal to control board 68. A CPU 76 mounted to control board 68 controls all aspects of the operation of clamp 10. CPU 76 comprises timers, counters, input and output portals, memory modules, and programmable instructions to regulate motion algorithms, error recovery, status messaging, test display, limit adjustment, and pushbutton control. Indicator lights 66 are connected to CPU 76.

Clamp 10 has pushbuttons 79, 81, 83, 85 on the exterior of housing 12 to permit a user to adjust the position to which CPU 76 will command the motor to move upon receiving a clamp or unclamp command. There is also a pushbutton 78 allowing CPU 76 to learn and memorize the clamped position based on when the motor stalls. This is usually a quicker way to set the programmed clamp position than by using pushbuttons 79, 81, 83, 85. All of those pushbuttons 78, 79, 81, 83, 85, as well as clamp/unclamp buttons 52, 54, are illustrated in FIG. 7.

CPU 76 controls motor drive circuit 80 and enabling circuit 82. Those circuits 80, 82 supply the drive current sent to slave motor 32 and motor 14. Because motor drive circuit 80 is easily damaged by logically inconsistent electrical input, enabling circuit 82 is used to independently assure logically consistent input. If excess current is detected by current monitor 84, such as may occur if clamp 10 is stalled or stuck, the output from motor drive circuit 80 is inhibited. A user may set an over-current threshold using over-current circuit 86.

All user interfaces described above are also found on remote pendant 88 (FIG. 5). Thus, remote pendant 88 allows a user to operate clamp 10 some short distance from clamp 10. This can be useful if clamp 10 is placed deeply within an automation tool, making the interfaces on housing 12 inaccessible. Lights 90 equivalent to indicator lights 66 are found on remote pendant 88, so clamp status information can be observed. Remote pendant power supply 91 (FIG. 5) provides electrical power to clamp 10 through remote pendant 88 via connector 93 on cover plate 58. This is useful if conventional power is unavailable, as is often the case in the early stages of building an automation system. Pushbuttons 92, 94, 96, 98, 100, 102, and 104, provide the same functionality as pushbuttons 78, 54, 52, 85, 83, 81, and 79, respectively, using remote pendant 88.

Clamps used in the automation industry are commonly used in conjunction with hundreds of other clamps, each clamp performing a specific function in a carefully choreographed manner. Often the multitude of clamps is controlled by a central controller issuing commands to the various clamps at the proper time. Clamp 10 accepts such external control commands through interface 106 (FIG. 7). Clamp 10 is typically isolated from the external controller using optical isolators 108, however simple lights or light emitting diodes (LEDs) may also be used. The lights or LEDs can convey essential status information such as clamped, unclamped, or a fault condition. This information can be passed to the central controller as well.

The present invention offers many advantages over the prior art. Housing the electronics controlling the clamp internally is a significant advantage. Using two motors in tandem is a new and useful arrangement for making a more powerful electric clamp while staying within industry size standards. The remote control provided by the remote pendant is another novel advantage, as is the ability to drive the clamp with power supplied through the remote pendant when normal power is unavailable. The use of an encoder rather than limit switches allows for more intelligent, and more easily modified control. Being able to manually move the clamp using the thumb wheel allows for quick remedy for stuck or defective control condition. The ability to program a clamped and an unclamped position is new and useful, as is the ability to use software to command the clamp to stop when an unrecoverable stuck condition is sensed. The clamp allows for automatic learning of the programmed clamp and unclamped positions, and allows a user to fine tune those positions, if desired.

While the invention has been particularly shown and described with reference to a preferred and alternative embodiments, it will be understood by those skilled in the art that various changes in form and detail may be made therein without departing from the spirit and scope of the invention.

What is claimed is:

1. An apparatus comprising:

a housing;

an electric motor attached to and disposed within the housing and having a motor shaft;

a motor gear attached to and rotationally driven by the motor shaft;

a ball nut gear coupled to and rotationally driven by the motor gear;

a ball nut coupled to and rotationally driven by the ball nut gear;

a ball screw mounted within and translationally driven by the ball nut as the ball nut is rotated relative to the ball screw, wherein the ball screw is entirely enclosed within the housing;

an output shaft and a linkage linking the ball screw to an output shaft, wherein the output shaft has a mounting point for a movable element that permits the movable element to at least partially extend from the housing; and a control circuit within the housing for controlling the motor.

2. The apparatus of claim 1 further comprising:

a clamp arm attached to the output shaft and at least partially extending from the housing; and a sensor that provides a signal to the control circuit indicative of a current position of the clamp arm.

3. The apparatus of claim 2, wherein the sensor comprises an encoder and wherein the signal provided to the control circuit is indicative of a rotational position the motor shaft.

4. The apparatus of claim 1 further comprising a remote pendant control attached by a remote pendant control cable to the housing and electrically connected to the control circuit.

5. The apparatus of claim 1, and further comprising a clamp arm attached to the output shaft.

6. The apparatus of claim 5 further comprising:

a pair of electrical switches mounted on the housing in which one switch actuates the clamp arm to drive toward a clamped position, and the other switch actuates the clamp arm to drive toward an unclamped position.

7. The apparatus of claim 1, wherein said external control interface includes power connections and communicates only status and command information.

8. The apparatus of claim 7, wherein:

said movable element comprises a clamp arm; and said status information includes at most clamped, unclamped and fault indications.

9. A clamp comprising:

a housing;

an electric motor attached to the housing and having a motor shaft;

a motor gear attached to and rotationally driven by the motor shaft;

a ball nut gear rotationally driven by the motor gear;

a ball nut coupled to and rotationally driven by the ball nut gear;

a ball screw mounted within and translationally driven by the ball nut as the ball nut is rotated relative to the ball screw;

a stop collar adjustably mounted on the ball screw to limit translational movement of the ball screw;

an output shaft and a linkage linking the ball screw to the output shaft; and a clamp arm attached to the output shaft.

10. A clamp comprising:

a housing;

an electric motor attached to the housing and having a motor shaft;

a thumb wheel rigidly attached to the motor shaft, the thumb wheel being accessible from outside of the housing for manually rotating the motor shaft;

a motor gear attached to and rotationally driven by the motor shaft;

a ball nut gear rotationally driven by the motor gear;

a ball nut coupled to and rotationally driven by the ball nut gear;

a ball screw mounted within and translationally driven by the ball nut as the ball nut is rotated relative to the ball screw;

a linkage linking the ball screw to an output shaft; and a clamp arm attached to the output shaft.

11. The clamp of claim 10, wherein the thumb wheel is inside the housing but accessible through a port in the housing, the port of the housing being covered by a movable door.

12. An apparatus comprising:

a first motor having a first motor shaft;

a second motor having a second motor shaft;

a threaded rod that is linearly moveable relative to the first and second motor shafts between retracted and extended positions;

a drive member having internal threads that engage the rod when rotated, causing the rod to move between the retracted and extended positions when the drive member is rotated relative to the threaded rod;

a coupling mechanism coupling each of the first and second motor shafts and the drive member in tandem for selectively rotating the drive member;

an output shaft and a linkage linking the rod to an output shaft, wherein the output shaft has a mounting point for a movable element;

a control circuit for controlling the motor; and a housing entirely enclosing the first and second motors, the rod, the drive member, the coupling mechanism, and the control circuit.

13. The clamp of claim 12 in which the first and second motor shafts are parallel to each other and to the rod.

14. The apparatus of claim 12, and further comprising a clamp arm attached to the output shaft and at least partially extending from the housing.

15. The apparatus of claim 12, and further comprising:

a clamp arm attached to the output shaft, and a sensor that provides a signal to the control circuit indicative of a current position of the clamp arm.

16. The apparatus of claim 15, wherein the sensor comprises an encoder and wherein the signal provided to the control circuit is indicative of a rotational position the first motor shaft.

17. An electric clamp comprising:

a housing;

a first motor mounted in the housing and having a first motor shaft;

a first motor gear attached to and rotationally driven by the first motor shaft;

a ball nut gear rotationally driven by the first motor gear;

a second motor mounted in the housing and having a second motor shaft;

a second motor gear attached to and rotationally driven by the second motor shaft, the second motor gear being rotationally coupled to the ball nut gear;

a ball nut coupled to and rotationally driven by the ball nut gear;

a ball screw mounted within and translationally driven by the ball nut as the ball nut is rotated relative to the ball screw;

a stop collar adjustably mounted on the ball screw for selectively limiting translational movement of the ball screw;

an output shaft and a linkage linking the ball screw to the output shaft; and a clamp arm mounted to the output shaft.

18. An electric clamp comprising:

a housing;

a first motor mounted in the housing and having a first motor shaft;

a first motor gear attached to and rotationally driven by the first motor shaft;

a ball nut gear rotationally driven by the first motor gear;

a second motor mounted in the housing and having a second motor shaft;

a second motor gear attached to and rotationally driven by the second motor shaft, the second motor gear being rotationally coupled to the ball nut gear;

a ball nut coupled to and rotationally driven by the ball nut gear;

a ball screw mounted within and translationally driven by the ball nut as the ball nut is rotated relative to the ball screw;

an output shaft and a linkage linking the ball screw to the output shaft;

a clamp arm mounted to the output shaft; and an encoder attached to the first motor shaft that provides a signal indicating the amount of rotational movement of the first motor shaft from an initial position to determine a current position of the clamp arm.

19. An electric clamp comprising:

a housing;

a first motor mounted in the housing and having a first motor shaft;

a first motor gear attached to and rotationally driven by the first motor shaft;

a ball nut gear rotationally driven by the first motor gear;

a second motor mounted in the housing and having a second motor shaft;

a brake attached to the second motor shaft;

a second motor gear attached to and rotationally driven by the second motor shaft, the second motor gear being rotationally coupled to the ball nut gear;

a ball nut coupled to and rotationally driven by the hub;

a ball screw mounted within and translationally driven by the ball nut as the ball nut is rotated relative to the ball screw;

an output shaft and a linkage linking the ball screw to the output shaft; and a clamp arm mounted to the output shaft.

20. An electric clamp comprising:

a housing;

a first motor mounted in the housing and having a first motor shaft;

a first motor gear attached to and rotationally driven by the first motor shaft;

a ball nut gear rotationally driven by the first motor gear;

a second motor mounted in the housing and having a second motor shaft;

a thumb wheel rigidly attached to the second motor shaft for manually rotating the second motor shaft;

a second motor gear attached to and rotationally driven by the second motor shaft, the second motor gear being rotationally coupled to the ball nut gear;

a ball nut coupled to and rotationally driven by the hub;

a ball screw mounted within and translationally driven by the ball nut as the ball nut is rotated relative to the ball screw;

an output shaft and a linkage linking the ball screw to the output shaft; and a clamp arm mounted to the output shaft.

21. An apparatus comprising:

a housing;

an electric motor attached to and disposed within the housing and having a motor shaft;

a motor gear attached to and rotationally driven by the motor shaft;

a ball nut gear coupled to and rotationally driven by the motor gear;

a ball nut coupled to and rotationally driven by the ball nut gear;

a ball screw mounted within and translationally driven by the ball nut as the ball nut is rotated relative to the ball screw, wherein the ball screw is entirely enclosed within the housing;

an output shaft and a linkage linking the ball screw to an output shaft;

a movable element coupled to the output shaft and at least partially extending outside the housing;

a control circuit within the housing for controlling the motor; and an external control interface coupled for communication to said control circuit that communicates command and status information between said control circuit and a remote central controller.

* * * * *